US005833222A

United States Patent [19]

Olden et al.

[11] Patent Number: 5,833,222

[45] Date of Patent: Nov. 10, 1998

[54] JIG FOR FORMING MULTIPLE TRUSSES

[75] Inventors: Marc Olden, Pacific; Adolfo Castillo, St. Charles, both of Mo.

[73] Assignee: MiTek Holdings, Inc., Wilmington, Del.

[21] Appl. No.: 733,760

[22] Filed: Oct. 18, 1996

[51] Int. Cl.[6] ..... B25B 1/20

[52] U.S. Cl. ..... 269/37; 269/910; 269/304; 269/303; 29/281.3; 100/100

[58] Field of Search ..... 269/37, 91, 92, 269/910, 905, 303, 304, 311, 297, 42; 29/281.3; 100/100

[56] References Cited

U.S. PATENT DOCUMENTS

| | | | |
|---|---|---|---|
| 3,826,188 | 7/1974 | Eberle | 100/100 |
| 3,855,917 | 12/1974 | Farrell et al. | 100/100 |
| 3,866,530 | 2/1975 | Moehlenpah | 100/53 |
| 4,024,809 | 5/1977 | Moehlenpah | 100/100 |
| 4,339,117 | 7/1982 | Tison | 269/303 |
| 4,379,426 | 4/1983 | Thompson et al. | 100/100 |
| 4,384,515 | 5/1983 | Matlock | 100/100 |
| 4,995,146 | 2/1991 | Woods | 29/281.3 |
| 5,092,028 | 3/1992 | Harnden | 29/281.3 |
| 5,280,893 | 1/1994 | Sixtensson | 269/37 |
| 5,617,622 | 4/1997 | Anderson | 269/37 |

FOREIGN PATENT DOCUMENTS

| | | |
|---|---|---|
| 152331 | 7/1953 | Australia . |
| 405272 | 8/1970 | Australia . |
| 1122377 | 4/1982 | Canada . |
| 1073305 | 6/1967 | United Kingdom . |
| 1367893 | 9/1974 | United Kingdom . |

*Primary Examiner*—James G. Smith
*Assistant Examiner*—Lee Wilson
*Attorney, Agent, or Firm*—Senniger, Powers, Leavitt & Roedel

[57] ABSTRACT

A jig for forming multiple trusses at the same time is capable of clamping the trusses together to simultaneously adhere trimmable blocks to the truss so that the truss can be cut off to different lengths. The jig has floating spacers which translate forces applied to components of one truss on one side of the jig through all of the components of all other trusses in the jig. The same truss can be formed with different modular lengths by selection of a fixed dimension central opening and the number of web members to be used. All other dimensions of the web between upper and lower chords of the truss remain the same.

15 Claims, 5 Drawing Sheets

48
46
52
50
52
54
48
36

62
58B 58B
24
24A
6
62
6
62
30
62
68
72
86
84
74
B
76

36
78
82
66
70
80
84
86
68
72
74

JIG FOR FORMING MULTIPLE TRUSSES

BACKGROUND OF THE INVENTION

This invention relates generally to jigs for forming trusses and more particularly to a jig for forming multiple trusses at the same time.

It is well known to use a jig in which components of a truss are placed in the arrangement they will have when the truss is finally formed. Typically the truss includes an upper chord and a lower chord, which each may be formed as one piece or as multiple pieces connected together. Web members extending between the upper and lower chords are connected to the upper and lower chords by nailing plates. The nailing plates are also placed in the jig, both on top of the chords and web members and underneath the chords and web members. A press is used to drive the nailing plates into the chords and web members to interconnect the chords and web members.

A trimmable flat truss is typically formed with upper and lower parallel, spaced apart chords made of a material which may be readily sawn through (e.g., wood). Generally V-shaped web members extend between the upper and lower chords along the length of the truss. The web members are typically made of metal and have nailing teeth punched out of them so that the web members themselves constitute both structural members extending between the chords and connectors. There may also be wooden web members extending between the upper and lower chords. At the ends of the truss, wooden blocks are glued between the upper and lower chords. The wooden blocks (and the upper and lower chords) may be sawn through to decrease the length of the truss to the length desired. Thus, a trimmable truss permits the builder to adapt a truss in the field for use to span one of several different distances.

Trimmable flat trusses of this type are commonly used as floor joists, in place of 2×10's and 2 ×12's. In order to be competitive with conventional solid wood joists, the flat truss must be equally as sturdy and yet competitive on a cost basis. Typically, flat trusses equal and exceed the performance capabilities of conventional solid wood joists. However, the flat truss must be assembled from several component parts requiring time, labor and equipment. Conventionally, flat trusses have been assembled on special jigs and associated presses have been used to connect the various components together. The components of one flat truss are placed in the jig, and the nailing plates or metal web members, as described above, are pressed into the wood of the upper and lower chords to connect the components together and for the truss. It is known to provide two jigs for assembling flat trusses on opposite sides of a press which alternately move into a central press for joining the components together. However, there is still a need for greater efficiency in production.

SUMMARY OF THE INVENTION

Among the several objects and features of the present invention may be noted the provision of a jig which is capable of use in simultaneously forming multiple trusses; the provision of such a jig which permits the components of the multiple trusses to be placed in the jig without jamming; the provision of such a jig which facilitates the gluing of trimmable blocks to upper and lower chords of the trusses; the provision of such a jig which permits the components to be placed in the jig rapidly by no more laborers than employed conventionally to assemble the components of a single truss in a jig; the provision of such a jig which forms multiple trusses with substantially identical camber; the provision of such a jig which facilitates the precise location of connectors in the jig; the provision of such a jig which is capable of automatically ejecting the completed trusses from the jig; and the provision of such a jig which is economical to make and easy to use.

Further among the several objects and features of the present invention may be noted the provision of a method for assembling trimmable trusses of different modular lengths; the provision of such a method which allows most of the same components to be used for trusses of all different modular lengths; and the provision of such a method which may be carried out easily.

Generally, a jig for simultaneously forming multiple trusses comprises a deck for simultaneously supporting components of the multiple trusses. The components of the trusses include spaced apart chords and web members extending between and connecting the chords. Clamping means of the jig comprises force applicator means for applying a clamping force to one of the chords of one of the trusses and anvil means for providing a reaction surface in opposed relation with the force applicator means. The anvil means is engageable with one of the chords of another of the trusses. Spacer means intermediate the force applicator means and the anvil means is mounted on the deck for movement relative to the deck, and is engageable with chords other than the chords engaged by the force applicator means and the anvil means when the truss components are supported on the deck. The spacer means is adapted to transmit the clamping force applied by the force applicator means to the chord of the one truss through the multiple trusses supported on the table to the anvil means, thereby to simultaneously clamp the multiple trusses in the jig.

Generally, a method for forming flat trusses of different modular lengths includes the steps of providing permanent web members of a single predetermined length and selecting a central opening of a single fixed dimension corresponding to the spacing between adjacent permanent web members at the center of the truss. A first length of trusses to be formed is selected by choosing a first number of permanent web members to be arranged one after another between the central opening and the ends of each truss. Upper and lower chords having a length corresponding to the selected first length are secured together with the permanent web members, with the chosen first number of permanent web members on either side of the central opening thereby to form trusses of the first selected length. A second length of the trusses to be formed is selected by choosing a second number of permanent web members to be arranged one after another between the central opening and the ends of each truss. Upper and lower chords having a length corresponding to the selected second length are secured together with the permanent web members, with the chosen second number of permanent web members on either side of the central opening thereby to form trusses of the second selected length.

Other objects and features of the present invention will be in part apparent and in part pointed out hereinafter.

BRIEF DESCRIPTION OF THE DRAWINGS

FIG. 3A is a further enlarged, fragmentary top plan view showing a central region of the lower jig of FIG. 3;

Corresponding reference characters indicate corresponding parts throughout the several views of the drawings.

DETAILED DESCRIPTION OF THE PREFERRED EMBODIMENT

Figure 1:
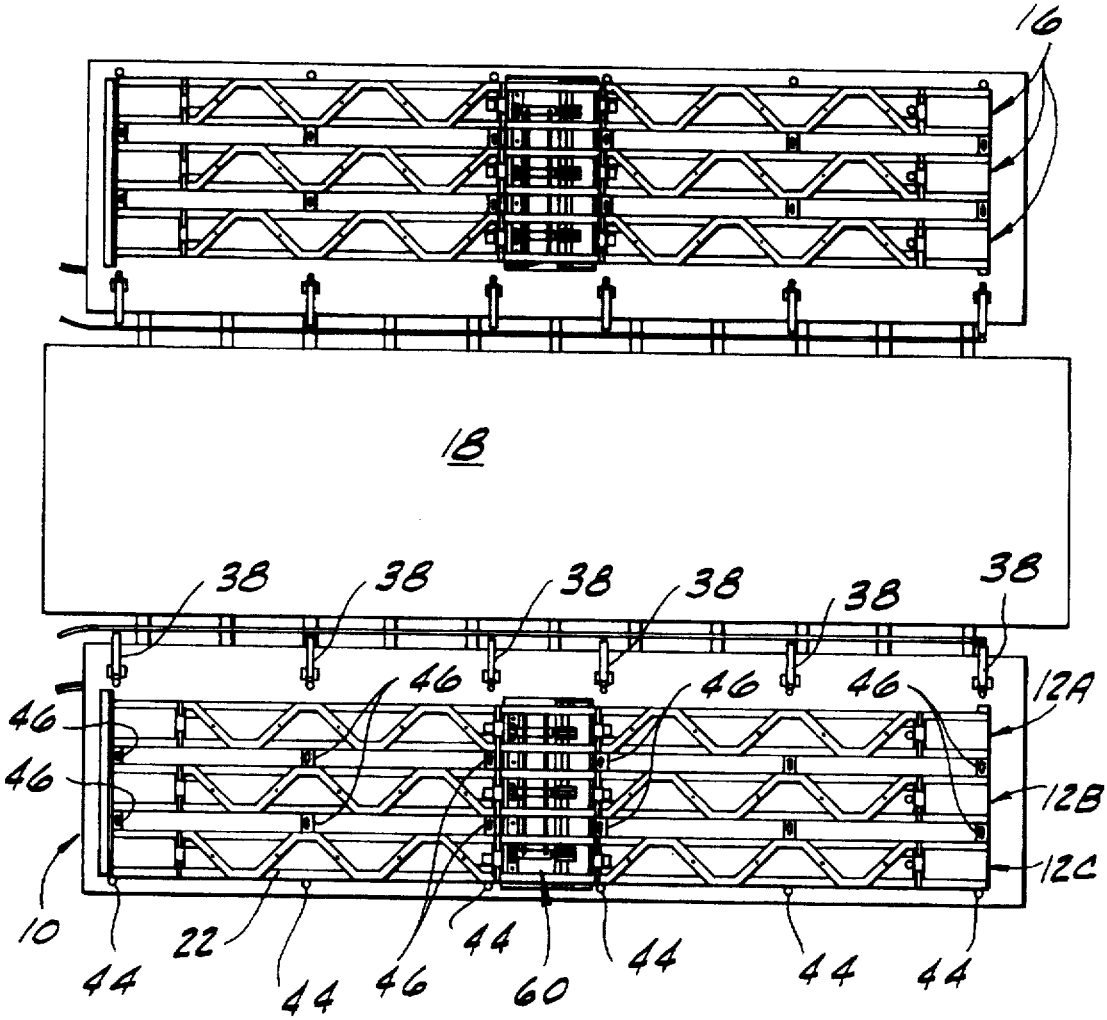
FIG. 1 is a top plan view of truss forming apparatus of the present invention including a pair of jigs and a press.

Referring now to the drawings, and in particular to FIG. 1, apparatus for forming flat trusses is shown to comprise a first jig 10 for receiving components of multiple flat trimmable trusses 12A–12C, a second jig 14 for receiving components of multiple trusses 16 and a press 18 between the first and second jigs (all reference numerals indicating their subjects generally). The jigs 10, 14 are mounted for moving into and out of the press 18. The structure (not shown) for moving the jigs 10, 14 into and out of the press 18 is well known to those of ordinary skill in the art. An example of a commercially available dual table press of this type is the Mark 100 Double Jig MH Press, Model No. MH18, manufactured by Mitek Industries, Inc. of Earth City, Mo. As shown in FIG. 1, the assembled but unconnected components of three trusses 12A–12C lie in the first jig 10 and the assembled but unconnected components of the three additional trusses 16 lie in the second jig 14. In practice, one of the jigs 10, 14 would be moved into the press 18 to interconnect the assembled components prior to completion of assembly of the components in the other jig.

Figure 2:
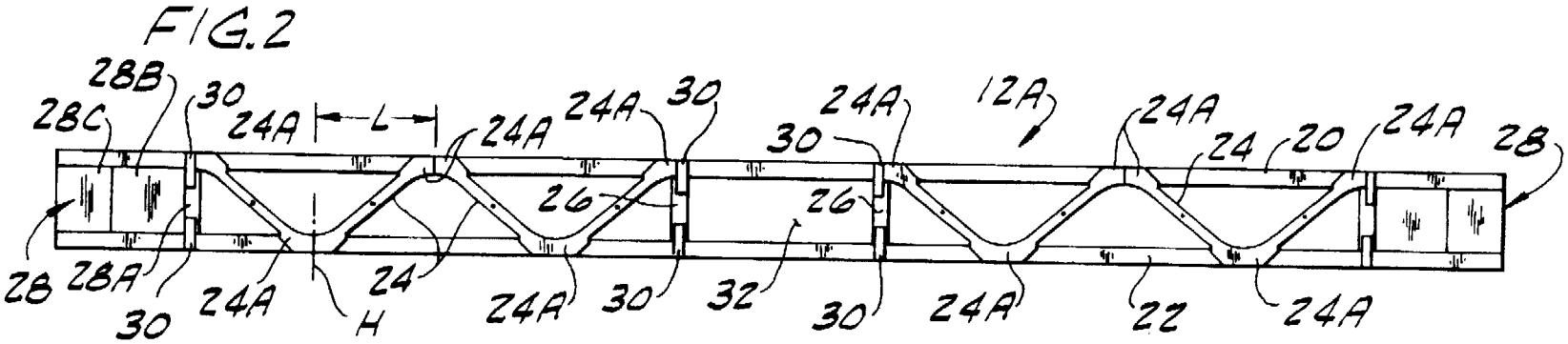
FIG. 2 is a side elevation of a trimmable flat truss formed with the truss forming apparatus of FIG. 1.

As shown in FIG. 2, a flat trimmable truss (e.g., truss 12A) made with the truss forming apparatus includes an upper chord 20 and a lower chord 22 connected together by web members. The web members include generally V-shaped metal web members 24, cross pieces 26 and trimmable blocks (broadly, "trimmable web members") indicated generally at 28. The metal web members 24 are of conventional construction, including connector portions 24A which are formed with teeth (not shown) embedded in the upper and lower chords 20, 22. The web members 24 are pre-formed with frangible portions (not shown) so that it is possible to break each metal web member in two (along line H as shown in FIG. 2), and use only half of the metal web member to span between the chords 20, 22. Metal web members 24 are also disposed on the other side of the truss 12A, directly behind the metal web members seen in FIG. 2. The cross pieces 26 extend transversely between the upper and lower chords 20, 22 and are connected to the chords by nailing plates 30. The cross pieces 26 define a central opening 32 for receiving ductwork and the like through the truss 12A.

The trimmable blocks 28 are located at the both ends of the truss 12A in the preferred embodiment. However, it is to be understood that a trimmable block may be provided at only one end of a truss (not shown) without departing from the scope of the present invention. The upper and lower chords 20, 22, and trimmable blocks 28 are made of wood and may readily be cut through to shorten the length of the truss 12A to the size required. In the illustrated embodiment, the blocks 28 are formed from three suitably sized pieces of scrap lumber which are glued together prior to assembly in the truss. The trimmable blocks 28 are connected to the upper and lower chords 20, 22 with a suitable adhesive. In the preferred embodiment, E9244 polyurethane elastomeric adhesive available from ITW Foamseal of Oxford, Mich. is used to join the blocks 28 to the chords 20, 22. It is to be understood that the jig and truss forming apparatus of the present invention may be used to form other than trimmable trusses without departing from the scope of the present invention. Moreover, it is envisioned that the principles of the present invention may be applied to the formation of other types of trusses other than flat trusses.

In the preferred embodiment, trusses can be made in one of any of several different selected lengths. For simplicity of manufacture, the central opening 32 and the trimmable blocks 28 are selected to be of exactly the same dimensions, regardless of the length of truss being manufactured. The sum of the lengths of the central opening 32 and the trimmable blocks 28 defines a base length of the truss, which is increased in predetermined, fixed increments defined by a length L equal to one have the length of the metal web members 24. The metal web members 24 may be broken in half at the base of the "V" (where indicated by line H in FIG. 2) to provide incremental changes of length L. The length of the truss is selected by determining the number of metal web member halves between the central opening and the trimmable blocks 28 on each side of the central opening. In the illustrated embodiment, the increments may be two feet, if an entire metal web member 24 is added or taken away, or one foot if only a half of a metal web member 24 is added or taken away. Each half of the metal web member 24 constitutes the "permanent web member" in the illustrated embodiment.

Upper and lower chords 20, 22 may be provided in several different lengths which are equal to a base length plus a multiple of the length L of one half of the metal web members 24. In this way, trusses of several different lengths may be formed with little disruption in the manufacturing process. A laborer need only select the number of metal web members 24 (or halves thereof) to be used between the central opening 32 and each of the trimmable blocks 28, and the corresponding length for the upper and lower chords. Different jigs (not shown) would be necessary to assemble trusses of different lengths. The jigs would be substantially the same as the first and second jigs 10, 14, but having a greater or lesser number of the same components between the center and each end to accommodate the additional metal web members. It is to be understood that trusses of different lengths may be formed using procedures other than described without departing from the scope of the present invention.

Figure 3:
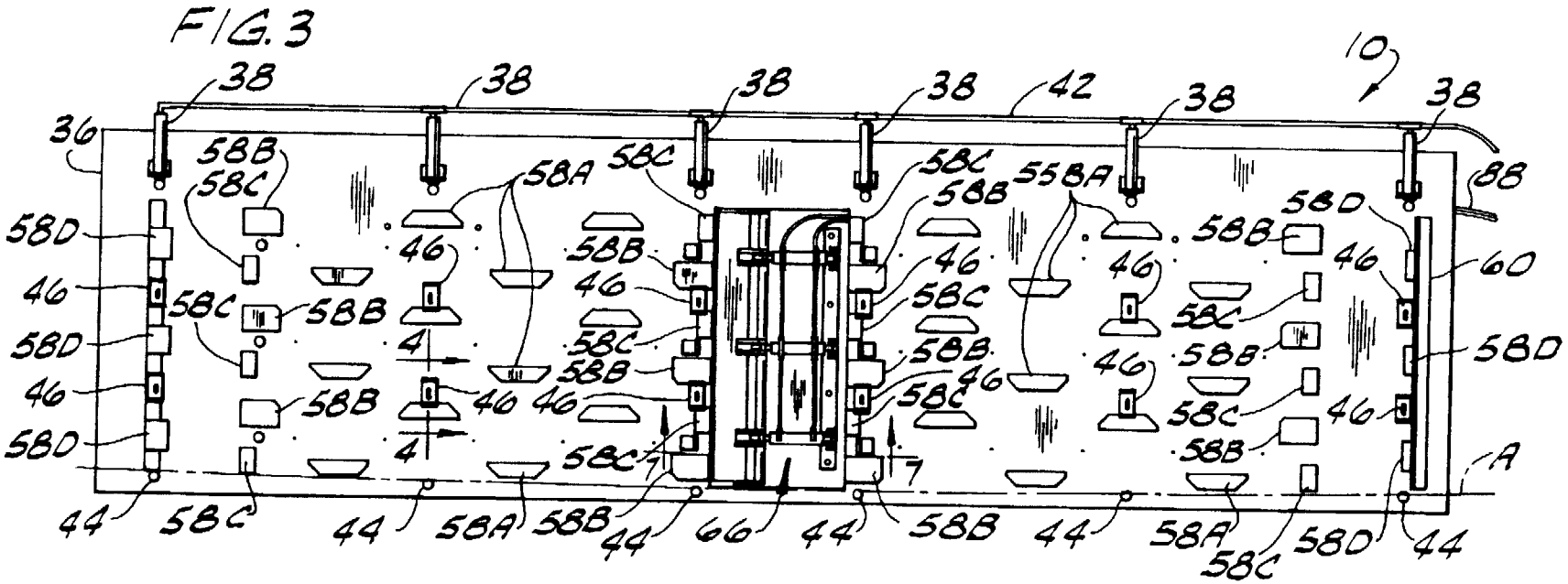
FIG. 3 is an enlarged top plan view of the lower jig shown in FIG. 1.
Figure 5A:
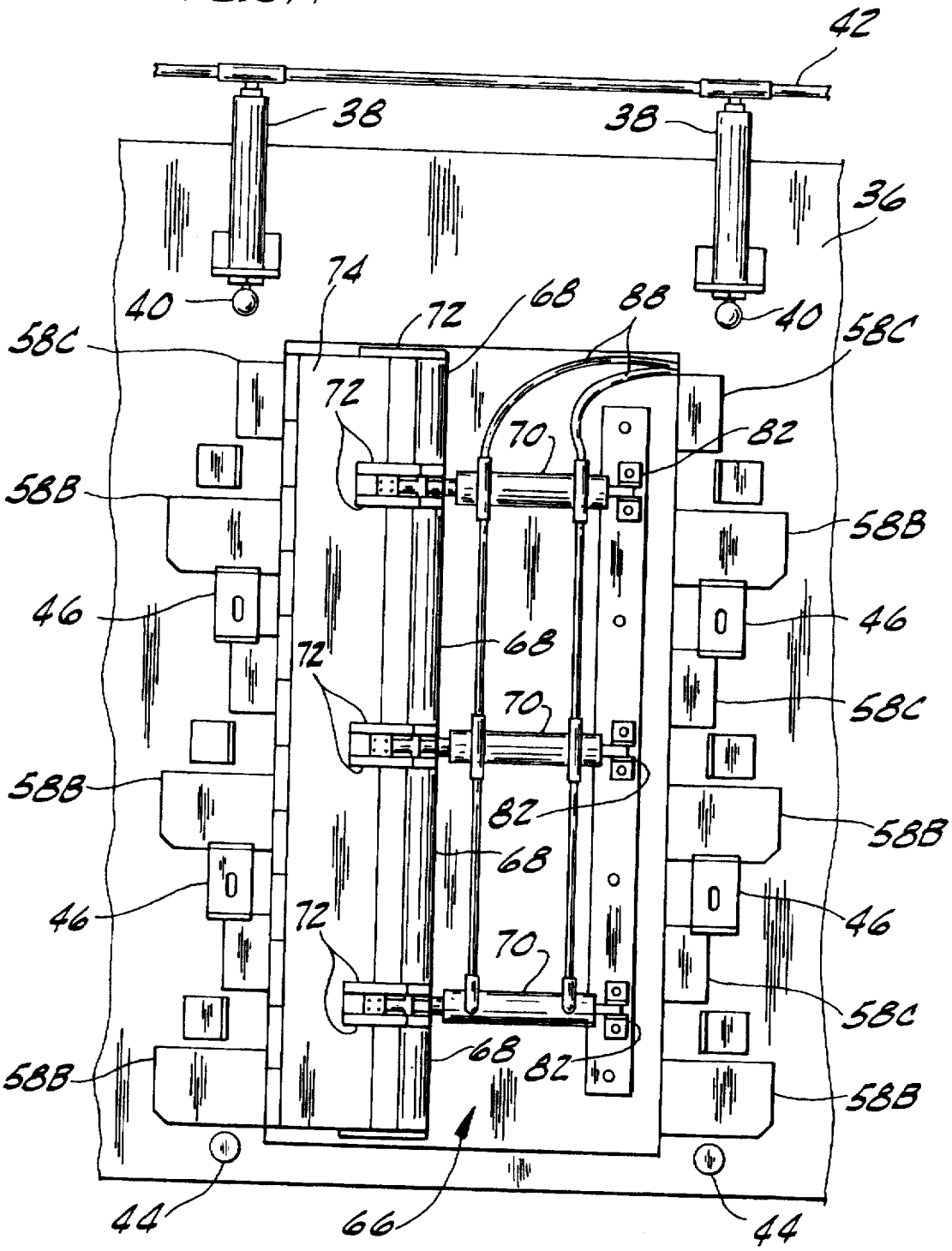
FIG. 5 is an enlarged top plan view of a platform for holding a connector used to join the truss components together.

The first and second jigs 10, 14 are of substantially identical construction. Thus, the description of the first jig 10 given herein will suffice for a description of the second jig 14. Referring now to FIGS. 3 and 3A, the first jig 10 is shown to comprise a rectangular deck 36 forming the structural member on which the elements of the jig are mounted and the components of trusses 12A–12C are supported. In the preferred embodiment, the deck 36 includes a base made of UHMW plastic covered on its upper surface by a sheet of ⅛ inch steel secured to the base with screws (not shown). Along one longitudinal edge of the deck 36 are mounted spaced apart pneumatic cylinders 38 having clamping members 40 mounted on the ends of rods (not shown) of the cylinders. The clamping cylinders 38 are connected by a common line 42 to suitable source of air pressure (not shown) by way of suitable control valving (not shown) for selectively extending and retracting the clamping members 40 to apply a clamping force to the components of the trusses 12A–12C, as will be described more fully hereinafter.

Six stops 44 fixedly attached to the deck 36 along the opposite longitudinal edge margin are, as shown in FIG. 1, engageable with the lower chord 22 of the outer truss 12C on the first jig 10. Each stop 44 is positioned directly opposite a corresponding one of the clamping cylinders 38. A greater or lesser number of stops, including a stop formed as a single piece (not shown), could be used without departing from the scope of the present invention. Stops 44 provide an anvil surface against which the clamping cylinders 38 clamp the trusses 12A–12C in the first jig 10. As shown in FIG. 3, the stops 44 are arranged in spaced apart locations along an arc A between the ends of the deck in order to introduce a camber to the trusses formed in the jig 10, as described more fully below. The arc A in FIG. 3 has been exaggerated from its actual curvature so that it can be seen on the scale of the drawing figures. In the illustrated embodiment, the first jig 10 is constructed to simultaneously form three trimmable flat trusses 12A–12C, as shown in FIG. 1. The clamping cylinders 38 and the stops 44 constitute clamping means in the preferred embodiment.

Figures 4, 5, 6, 7:
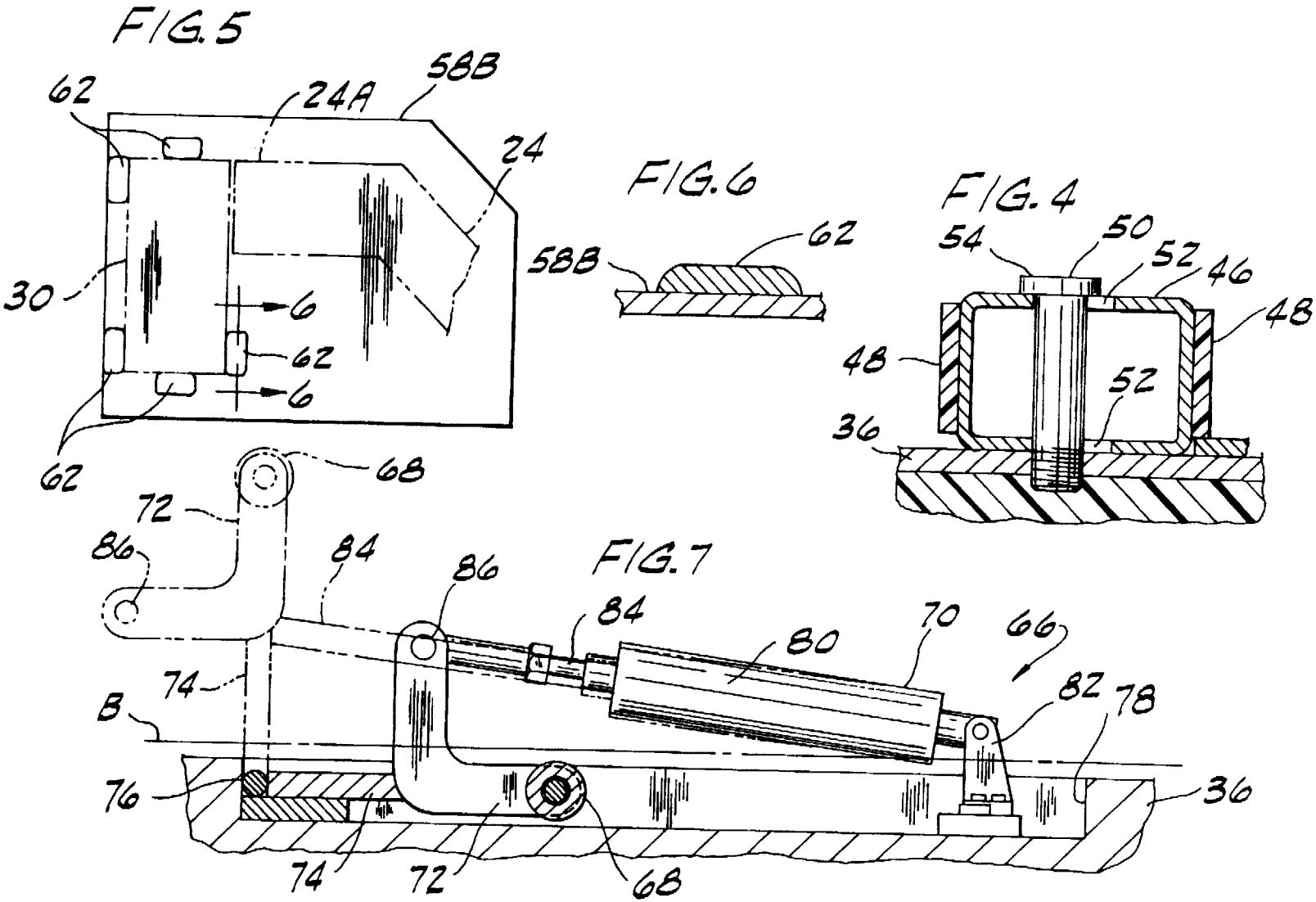
FIG. 4 is a sectional view taken in the plane including line 4—4 of FIG. 3 and showing a floating spacer.
FIG. 6 is a sectional view taken in the plane including line 6—6 of FIG. 5.
FIG. 7 is an enlarged, cross sectional view taken in the plane of line 7—7 of FIG. 3 and showing an ejector of the jig.

Two rows of floating spacers 46 between each of the trusses 12A–12C are connected to the deck 36. Of course, a lesser or greater number of rows of floating spacers may be used without departing from the scope of this invention. The floating spacers 46 are constructed and arranged to transmit the clamping force applied to the components of the truss 12A adjacent the clamping cylinders 38 to the components of the other two trusses 12B, 12C being formed in the first jig 10. As shown in FIG. 4, the floating spacers 46 each comprise a section of box tubing mounting pads 48 on longitudinally opposite faces of the spacer. The pads 48 are made of UHMW plastic and are enageable with adjacent chords 20, 22 of the trusses 12A–12C. The pads 48 provide a low friction engagement with the adjacent chords 20, 22 so that the trusses are readily removed from the first jig 10. The floating spacer 46 is attached to the deck by a post 50 (broadly, "mounting means") which is threaded at its lower end for rigid threaded connection to the deck 36. The post 50 extends upwardly through elongate, vertically aligned openings 52 in the floating spacer. The openings 52 are elongate in a direction transverse to the lengthwise arrangement of the clamping cylinders 38 and stops 44. The post 50 has a head 54 of a diameter larger than the width of the upper opening 52 so that the spacer 46 is held on the deck 36 by the post. However, the spacer 46 is permitted to float by movement on the post relative to the deck in directions toward and away from the clamping cylinders 38 and the stops 44, but is held from movement parallel to the cylinders and stops. In the illustrated embodiment, the range of motion of the spacers 46 is approximately ⅝ inch. It is envisioned that the floating spacers in each row could be made of a single piece of flexible material (not shown), or could be provided in a greater or lesser number of spacers than illustrated without departing from the scope of the present invention.

The nailing plates 30 and connector portions 24A of the metal web members 24 are supported above the top surface of the deck 36 by platforms 58 mounted on and rising up from the top surface. Referring to FIG. 3, trapezoidal platforms 58A are shaped to support the connector portions 24A of the metal web members 24, which are also generally trapezoidal in shape. Platforms 58B hold the nailing plates 30 and a connector portion 24A, and platforms 58C hold nailing plates by themselves. Platforms 58D support the trimmable blocks 28 on level with the chords 20, 22 in the jig 10. A bar 60 at one end of the deck 36 longitudinally locates the ends of the chords 20, 22 of the trusses 12A–12C.

The platforms 58B and 58C for holding the nailing plates 30 and connector portions 24A of the metal web members 24, have locators 62 on them for positioning and positively locating the nailing plates on the deck 36. A representative connector platform 58B is shown in FIG. 5. One of the nailing plates 30 and a fragmentary portion of one of the metal web members 24 are shown in phantom in FIG. 5. The locators 62 comprise weld beads which are formed on the platform 58B in a spaced apart arrangement at least partially outlining the shape of one of the nailing plates 30. To accurately position the locators 62 on the platforms 58B, 58C, templates (not shown) are cut from a sheet of carbon black. The templates have the shape generally corresponding to the nailing plates. Spot welds defining the locators 62 are formed on the platforms 58B, 58C against the edges of the carbon black template. Because the carbon black will not be fused at the temperatures needed to form the metal welds, the carbon black template can be easily removed after the locators 62 are formed. The template not only accurately positions the locators 62, but also forms substantially vertical interior faces of the locators for engagement with the thin edges of the nailing plates 30.

Referring now to FIGS. 3 and 7, an ejector for ejecting trusses 12A–12C formed on the first jig 10 is generally indicated at 66. The ejector is comprises rollers 68 pivotally mounted on the deck 36 and three pneumatic ejector cylinders 70 for selectively moving the rollers between a first position (shown in solid lines in FIG. 7) and a second position (shown in phantom in FIG. 7). The rollers 68 are mounted for rotation between L-shaped members 72 (only one is shown). Each pair of L-shaped members 72 are connected to a plate 74 attached to the deck 36 by a hinge 76 in a recess 78 located in the center of the deck. The hinge 76 permits the L-shaped members 72 and rollers 68 to pivot between the first and second positions illustrated in FIG. 7. In the first position, the rollers 68 are positioned below the level at which the trusses 12A–12C are supported, indicated by line B in FIG. 7.

The ejector cylinders 70 each include a barrel 80 pivotally connected by a bracket 82 to the deck 36 in the recess 78, and a rod 84 selectively extensible from and retractable into the barrel. The free ends of the rods 84 extend generally between adjacent pairs of L-shaped members 72 and are pivotally connected to pins 86 (only one is shown) interconnecting the adjacent pairs of L-shaped members. The ejector cylinders 70 are connected by lines 88 (FIG. 3) and suitable valving (not shown) to the source of pressurized air for selectively extending and retracting the rods 84 to raise the rollers 68 to the second position and return them to the first position. The rollers 68 are positioned to underlie the chords 20, 22 of the trusses 12A–12C so that in the second, raised position, the trusses will roll off one end of the deck on the rollers.

Figure 8:
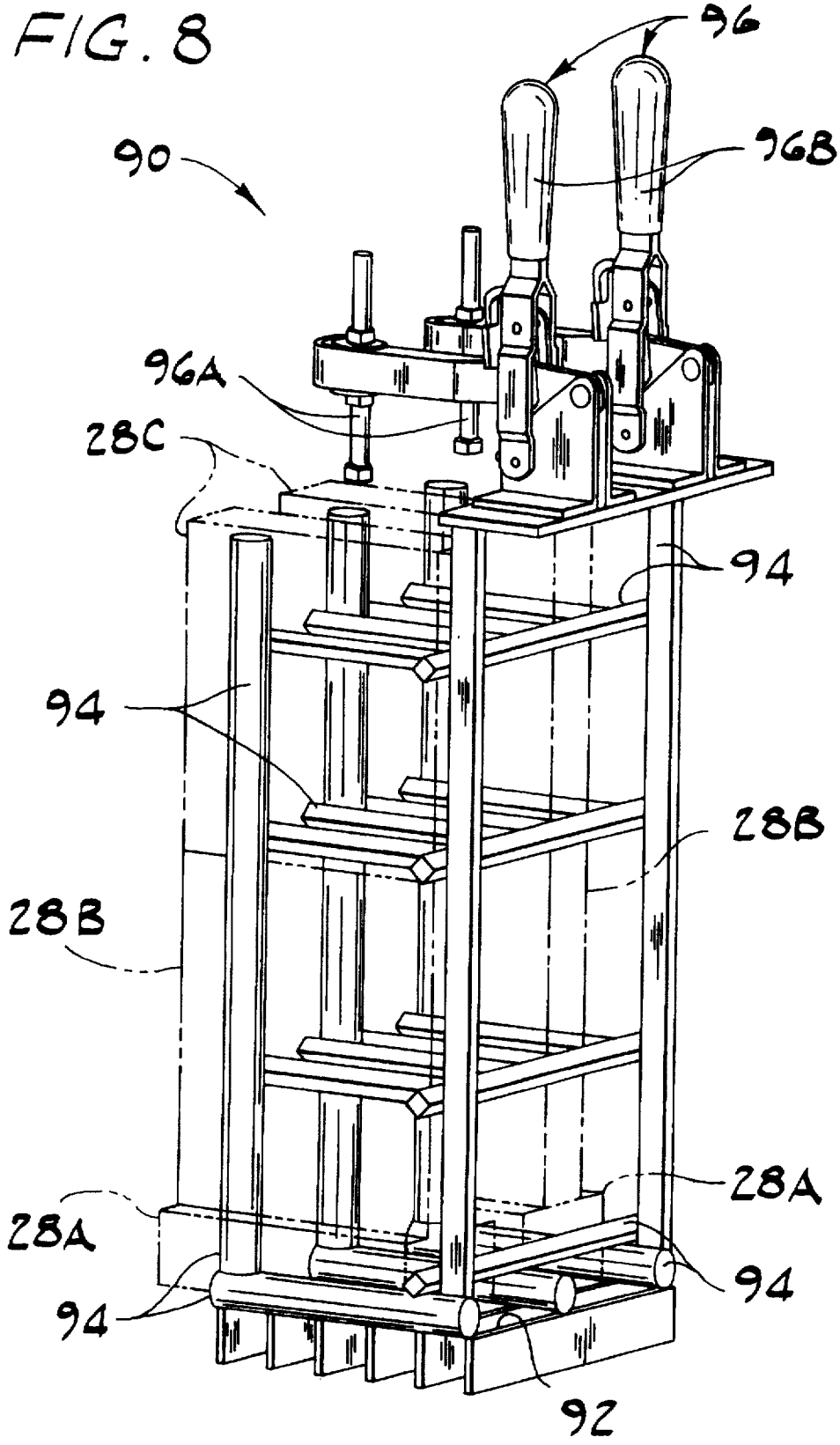
FIG. 8 is a rear perspective view of a fixture for pre-gluing trimmable blocks.

In operation of the truss forming apparatus, the length of the truss to be formed is selected according to the number of halves of metal web members 24 which will be used on each side of the truss between the central opening 32 and the trimmable block 28. The stock of upper and lower chords 20, 22 having the corresponding length is selected for use. Prior to assembly of the truss components in the first jig 10, the trimmable blocks 28 are formed in a fixture generally indicated at 90 in FIG. 8. In the illustrated embodiment, each trimmable block is formed of block elements comprising a 2×3 28A, a 2×6 28B and a 2×8 28C, which are readily available scrap pieces at a truss manufacturing facility. The 2×3 28A provides a base on which the other elements (28B, 28C) rest in the fixture 90. Rods 92 define a floor which is slanted toward the rear of the fixture 90 to urge the block elements 28A–28C to remain in the fixture. Metal rods 94 are welded together to define two compartments which are each capable of holding the elements 28A–28C of one trimmable block 28. The same adhesive which is used to bond the trimmable block 28 to the upper and lower chords 20, 22 is preferably used to bond the block elements 28A–28C together. Once the adhesive is applied, the block elements 28A–28C are clamped in the fixture 90. One clamp (generally indicated at 96) for each compartment is mounted on the rear of the fixture 90 and has a clamping arm 96A capable of engaging the top block element 28C in the fixture and applying a clamping force to secure the elements 28A–28C together. The clamp is operated by a lever 96B.

After the adhesive has bonded the block elements 28A–28C together to form the trimmable blocks 28, the clamp 96 is released and the blocks are taken out for assembly in a truss. As a result, the only gluing operation which occurs in the first jig 10 is the gluing of the previously formed trimmable blocks 28 to the upper and lower chords 20, 22. The simplification of the assembly of the truss components provides for greater precision and speed in the truss assembly process. The nailing plates 30 and metal web members 24 to be attached to the bottom sides of all three trusses 12A–12C are placed in the first jig 10, resting on the connector platforms 58A–58C so that the nailing plates and metal web members are all spaced slightly above the top surface of the deck 36. The nailing plates 30 and connector portions 24A of the metal web members are received in and positioned by the locators 62 on the platforms 58B.

The upper and lower chords 20, 22 of each truss 12A–12C are positioned in the first jig 10. The lower chord 20 of the outer truss 12C (spaced farthest from the press 18) is placed against the stops 44. The connector portions 24A of the metal web members 24 provide a guide for placement of the chords 20, 22 in the jig 10. The trimmable blocks 28 are then placed between the upper and lower chords 20, 22 of each truss on their respective platforms 58D. The cross pieces 26 are also placed between the chords 20, 22 and define the central opening 32 of the trusses. The cross pieces 26 are located longitudinally of the trusses 12A–12C by angle brackets 98 mounted on the deck 36 (FIG. 3A). The freedom of the floating spacers 46 to move permits the jig 10 to hold the chords 20, 22 loosely enough prior to application of a clamping force by the clamping cylinders 38 so that the cross pieces 26 and trimmable blocks 28 will slide easily between the chords. The floating spacers 46 also allow for some curvature along the length of the chords 20, 22 without causing the jig 10 to become jammed. Adhesive is applied to trimmable blocks 28, prior to placement of the blocks in the jig 10, on the surfaces of the trimmable blocks which will engage the chords 20, 22. Once the trimmable blocks 28 are inserted, the clamping cylinders 38 are activated to provide a clamping force to the truss components in the jig 10, permitting the trimmable blocks to become securely bonded to the chords 20, 22. In addition, a staple (not shown) may be secured to one of the chords and to provide additional assurance that the trimmable blocks 28 do not slip as the nailing plates 30 and connector portions 24A are driven into the wooden components in the press 18.

When the clamping cylinders 38 are activated, the clamping members 40 of the cylinders engage the chord 20 of the truss 12A nearest to the cylinders. The force applied by the clamping members 40 is transmitted from that chord through the web members (24, 26, 28) to the opposite chord 22 of the truss 12A. The opposite chord engages the floating spacers 46 which, because the spacers are allowed to float, transfers the force through to the upper chord 20 of the middle truss 12B in the jig 10. In the same way, the clamping force applied to the middle truss 12B is transferred by the second row of floating spacers 46 to the upper chord 20 of the outer truss 12C. However, when the force is transferred through the web members of the third truss 12C to its lower chord 22, which abuts the fixed stops 44, the chord is rigidly held and applies a reactive force through the trusses 12A–12C. Thus, all three trusses are clamped together by the clamping cylinders 38 and stops 44 for securing the trimmable blocks 28 between the respective chords 20, 22. The arc A of the fixed stops 44 and the floating spacers 46 permit relatively more displacement of the chords 20, 22 to occur in the middle of the trusses 12A–12C than at the ends. Thus, the clamping cylinders 38 and stops 44 cooperate to bow the chords 20, 22 of all of the trusses 12A–12C in the first jig 10 to achieve the desired camber of the final trusses. The floating spacers 46 cause the camber in each of the trusses 12A–12C to be substantially identical to the arc of the stops 44, without regard to the initial bowed or warped configuration of the chords 20, 22 when placed in the first jig 10.

The nailing plates 30 and metal web members 24 to be attached to each of the trusses 12A–12C on the top side are then placed on the chords 20, 22 and cross pieces 26, directly over the corresponding nailing plates and metal web members on the underside of the trusses. The truss forming apparatus is then activated to move the first jig 10 into the press 18 with the clamping force still being applied by the clamping cylinders 38. The press 18 drives the teeth (not shown) of the nailing plates 30 and the connector portions 24A of the metal web members 24 on the top sides of the trusses 12A–12C down into the chords 20, 22 and cross pieces 26. At the same time, the press 18 drives the chords 20, 22 and cross pieces 26 downwardly into the teeth of the nailing plates 30 and connector portions 24A of the metal web members on the bottom sides of the trusses 12A–12C. The trusses are now fixed in their form given by the application of the clamping force to the trusses. The first jig 10 is then moved out of the press 18, and the second jig 14 may be moved into the press.

To remove the assembled trusses 12A–12C from the first jig 10, the clamping cylinders 38 are activated to release the clamping force. Ejector cylinders 70 are activated to extend the rods 84 from the barrels 80. The rollers 68 are thus pivoted upwardly to the second position to lift one end of each truss off of the deck 36. The trusses 12A–12C may then be slid toward one end of the deck 36 and out of the first jig 10. The cycle time for the first jig 10 is approximately four minutes in a preferred embodiment.

The first jig 10 may be permanently or semi-permanently fixed to the table (not shown) of the truss forming apparatus, or may simply be laid onto the table of an existing truss forming apparatus. The weight of the first jig 10 is such that there will be no movement once placed on the table. It is envisioned that if the jig 10 is to be of the type removably placed on the table of an existing truss forming apparatus, the ejector 66 may be omitted.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A jig for simultaneously forming multiple trusses, the trusses formed by components including spaced apart chords, and web members extending between and connecting the chords, the jig comprising:

a deck for simultaneously supporting the components of the multiple trusses;

clamping means comprising force applicator means for applying a clamping force to one of the chords of one of the trusses and anvil means for providing a reaction surface in opposed relation with said force applicator means, said anvil means being engageable with one of the chords of another of the trusses;

spacer means intermediate said force applicator means and said anvil means is mounted on the deck for movement relative to the deck, said spacer means being engageable with chords other than the chords engaged by said force applicator means and said anvil means when the truss components are supported on the deck, said spacer means being adapted to transmit the clamping force applied by said force applicator means to the chord of said one truss through the multiple trusses supported on the table to said anvil means thereby to simultaneously clamp the multiple trusses in the jig.

2. A jig as set forth in claim 1 further comprising means for mounting said spacer means so that said spacer means is free to float relative to the table in directions toward and away from said force applicator means and said anvil means.

3. A jig as set forth in claim 2 wherein said mounting means restrains said spacer means from moving in directions parallel to said force applicator means and said anvil means.

4. A jig as set forth in claim 3 wherein said mounting means restricts the floating motion of said spacer means toward and away from said force applicator means and said anvil means to a selected range.

5. A jig as set forth in claim 3 wherein said spacer means comprises a plurality of spaced apart spacers, and wherein said mounting means comprises a post for each of the spacers, the posts being fixedly connected to the deck in at least one row intermediate said force applicator means and said anvil means, the spacers each having an elongate opening therein receiving a corresponding one of the posts therethrough for mounting the spacer to the deck.

6. A jig as set forth in claim 1 wherein said anvil means defines an arc from one end of said anvil means to the other end whereby the spaced apart chords of the truss engageable said anvil means under the clamping force applied by said force applicator means are provided with a camber corresponding to the arc defined by said anvil means, said force applicator means and said spacer means being adapted to transmit substantially the same camber of the chords of the truss engaging said anvil means to the other chords supported on the deck so that all trusses formed in the jig have substantially the same camber.

7. A jig as set forth in claim 6 wherein said anvil means comprises a plurality of spaced apart stops rigidly attached to the deck and arranged along the arc in opposed, spaced apart relation to said force applicator means.

8. A jig as set forth in claim 7 wherein said force applicator means comprises a plurality of cylinders selectively extensible and retractable for applying and releasing the clamping force.

9. A jig as set forth in claim 1 wherein the deck comprises a top surface and a plurality of platforms rising upwardly from the top surface for supporting connectors for interconnecting the chords of each truss above the top surface of the deck.

10. A jig as set forth in claim 9 wherein at least some of the platforms include locators for positioning the connectors on the platform, the locators comprising multiple beads welded onto the platform.

11. A jig as set forth in claim 1 further comprising an ejector for ejecting trusses formed on the deck from the deck, the ejector comprises rollers pivotally mounted on the deck and actuator means for selectively moving the rollers between a first position in which the rollers are disposed below a level at which the trusses are supported on the deck and a second position in which the rollers are raised above the level at which the trusses are supported on the deck.

12. A jig as set forth in claim 11 wherein the deck has a top surface having a recess therein, the ejector being mounted on the deck in the recess.

13. A jig as set forth in claim 12 wherein said actuator means comprises cylinders connected to the rollers, the cylinders being extensible and retractable for selectively moving the roller between said first and second positions.

14. A jig as set forth in claim 1 in combination with a press for pressing connectors into the chords for interconnecting the chords and web members.

15. A jig in combination with a press as set forth in claim 14 wherein the jig constitutes a first jig and further in combination with a second jig of substantially the same construction as the first jig, the first and second jigs being disposed on opposite sides of the press and adapted for alternately moving into the press.

* * * * *